United States Patent [19]

Morimoto et al.

[11] Patent Number: 5,035,790

[45] Date of Patent: Jul. 30, 1991

[54] HIGHLY DURABLE CATHODE WITH LOW HYDROGEN OVERVOLTAGE AND METHOD FOR PRODUCING THE SAME

[75] Inventors: Takeshi Morimoto; Naoki Yoshida, both of Yokohama, Japan

[73] Assignee: Asahi Glass Co., Ltd., Tokyo, Japan

[21] Appl. No.: 544,189

[22] Filed: Jun. 26, 1990

[30] Foreign Application Priority Data

Jun. 30, 1989 [JP] Japan ..... 1-167103

[51] Int. Cl.[5] ..... C25B 11/06

[52] U.S. Cl. ..... 204/290 R; 204/292; 204/293

[58] Field of Search ..... 204/290 R, 290 F, 291, 204/294, 292, 293

[56] References Cited

U.S. PATENT DOCUMENTS 4,789,452 12/1988 Morimoto et al. ..... 204/290 F 4,877,508 10/1989 Morimoto et al. ..... 204/293

*Primary Examiner*—John F. Niebling

*Assistant Examiner*—Kathryn Gorgos

*Attorney, Agent, or Firm*—Oblon, Spivak, McClelland, Maier & Neustadt

[57] ABSTRACT

Highly durable cathodes with a low hydrogen overvoltage, which comprises an electrode core and electrode active metal particles provided on the core, wherein at least a part of the electrode active metal particles is made of a hydrogen absorbing alloy capable of electrochemically absorbing and desorbing hydrogen, and the hydrogen absorbing alloy is represented by the formula:

$$MmNi_xAl_yM_z \quad (I)$$

wherein Mm is misch metal, M is at least one element selected from the group consisting of Mn, Cu, Cr, Co, Ti, Nb, Zr and Si, and $2 \geqq x \geqq 5$, $0 < y \geqq 3$, $0 < z \geqq 4$ and $2.5 \geqq x+y+z \geqq 8.5$, exhibit very low deterioration even under an oxidizing atmosphere.

7 Claims, 1 Drawing Sheet

HIGHLY DURABLE CATHODE WITH LOW HYDROGEN OVERVOLTAGE AND METHOD FOR PRODUCING THE SAME

BACKGROUND OF THE INVENTION

1. Field of the Invention

The present invention relates to a highly durable cathode with a low hydrogen overvoltage. More particularly, it is concerned with a cathode with a low hydrogen overvoltage, which shows a very low deterioration in its properties even under an oxidizing atmosphere, and with a method for its production.

2. Discussion of the Background

There have been proposed various cathodes with a low hydrogen overvoltage, in particular, cathodes for electrolysis of an alkali metal halide aqueous solution. Of these electrodes, the one which has previously been proposed by the present applicant and is disclosed in Unexamined Japanese Patent Publication No. 112785/1979 shows remarkable effects for low hydrogen overvoltage and durability as compared with electrodes which have been known before. However, as a result of further studies, the present inventors have found that, depending on circumstances, even the electrode as disclosed in the above Unexamined Japanese Patent Publication does not always exhibit sufficient durability, and, after strenuous efforts having been made for the solution of this problem, they have accomplished the present invention.

As an industrial method of manufacturing chlorine and caustic alkali, it is already well known to obtain halogen gas from an anode compartment and an aqueous solution of caustic alkali and hydrogen gas from a cathode compartment by electrolysis in an electrolytic cell of an alkali metal halide aqueous solution. As the cathode for this electrolytic cell, a cathode with a low hydrogen overvoltage as mentioned above is used preferably. However, such an electrolytic cell is obliged to have its operation stopped in the course of its running for various reasons, and, in such case, an increase of the hydrogen overvoltage has been observed when its operation is resumed. As the result of studying this phenomenon in depth, the present inventors have discovered that in the case where the operation of the electrolytic cell is stopped by a method of short-circuiting the anode and the cathode through a bus bar, the cathode is oxidized by reverse current generated at the time of the short-circuiting, and that in the case of cathode containing nickel and cobalt as its active components, these substances become modified to hydroxides, whereby the electrode activity will decrease and will not return to the original active state even after its operation has been resumed (i.e. the hydrogen overvoltage will increase).

Moreover, it has been found that even in the case where the operation is stopped simply by ceasing conduction of electric current without short-circuiting the anode and the cathode, if the cathode is immersed over a long period of time in an aqueous solution of NaOH at a high temperature and at a high concentration, the active component of the cathode, if made of nickel or cobalt, will have a corrosion potential and will be modified into its hydroxide (this reaction is also a sort of electrochemical oxidation reaction), whereby the electrode activity decreases.

SUMMARY OF THE INVENTION

Under the circumstances, studies were made strenuously with a view to preventing such phenomenon from taking place. As the result, it has been discovered that, when a hydrogen absorbing alloy which absorbs and desorbs hydrogen electrochemically and has a low hydrogen overvoltage, is used as a part or a whole of the electrode active component, a large amount of hydrogen absorbed in the hydrogen absorbing alloy is electrochemically oxidized at the time of stopping operation of the electrolytic cell as described in the foregoing, whereby the electrode active component can be effectively prevented from its oxidation; in other words, the electrode activity can be maintained over a long period of time. On the basis of this discovery, the present invention has been completed.

The present invention provides a highly durable cathode with a low hydrogen overvoltage, which comprises an electrode core and electrode active metal particles provided on the core, wherein at least a part of said electrode active metal particles is made of a hydrogen absorbing alloy capable of electrochemically absorbing and desorbing hydrogen, and said hydrogen absorbing alloy is represented by the formula:

$$MmNi_xAl_yM_z \quad (I)$$

wherein Mm is misch metal, M is at least one element selected from the group consisting of Mn, Cu, Cr, Co, Ti, Nb, Zr and Si, and $2 \leqq x \leqq 5$, $0 < y \leqq 3$, $0 < z \leqq 4$ and $2.5 \leqq x+y+z \leqq 8.5$. Misch metal means a mixture of cerium group rare earth elements. Usually it contains 40–50 weight % of cerium and 20–40 weight % of lanthanum.

The present invention also provides a method for producing a highly durable cathode with a low hydrogen overvoltage, which comprises immersing an electrode core in a plating bath, wherein particles of a hydrogen absorbing alloy represented by the formula:

$$MmNi_xAl_yM_z \quad (I)$$

wherein Mm is misch metal, M is at least one element selected from the group consisting of Mn, Cu, Cr, Co, Ti, Nb, Zr and Si, and $2 \leqq x \leqq 5$, $0 < y \leqq 3$, $0 < z \leqq 4$ and $2.5 \leqq x+y+z \leqq 8.5$. and being capable of electrochemically absorbing and desorbing hydrogen, are dispersed as at least a part of electrode active metal particles, and electrolytically co-depositing the electrode active metal particles on the electrode core together with a plating metal by a composite plating method.

DESCRIPTION OF THE PREFERRED EMBODIMENTS

Figure 1:
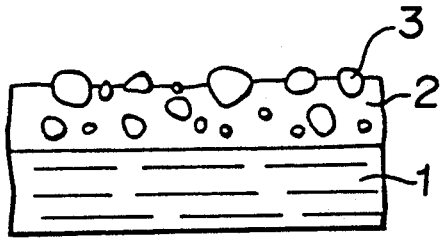
FIG. 1 is a cross-sectional view of the surface part of one embodiment of the electrode according to the present invention.

In this specification, "hydrogen absorbing alloy capable of electrochemically absorbing and desorbing hydrogen" is meant for an alloy which performs the following electrode reaction in an alkaline aqueous solution. Namely, in the reduction reaction, it reduces water and absorbs hydrogen atoms produced by the reduction of water; while, in the oxidation reaction, it performs a reaction wherein the absorbed hydrogen is reacted with hydroxide ions on the surface of such alloy to produce water. The reaction formula for the above will be shown below:

$$xH_2O + xe^- + A \underset{\text{(desorption)}}{\overset{\text{(absorption)}}{\rightleftharpoons}} AHx + xOH^- \quad (1)$$

In the above formula, A designates a hydrogen absorbing alloy, and AHx refers to a hydrogenated substance thereof. When the sodium chloride electrolysis is carried out by, for example, the ion exchange membrane method using a cathode, in which this hydrogen absorbing alloy is made a part or whole of the electrode active particles, hydrogen is absorbed in the hydrogen absorbing alloy at the initial stage of the electric current conduction due to the rightward reaction in the above reaction formula (1). As soon as the hydrogen absorption reaches its saturation, hydrogen is generated on the surface of the hydrogen absorbing alloy due to the following reaction (2), whereby the usual electrode reaction proceeds on the cathode.

$$H_2O + e^- \rightarrow 1/2\ H_2 + OH^- \quad (2)$$

On the other hand, at the time of stoppage of the operation of the electrolytic cell due to e.g. the short-circuiting thereof, a large amount of hydrogen which has been absorbed in the hydrogen absorbing alloy is desorbed electrochemically due to the leftward reaction in the above reaction formula (1). Namely, by the electrochemical oxidation of hydrogen to bear the oxidation current, the oxidation of the electrode active particles per se can be effectively prevented.

Thus, as described in the foregoing, the hydrogen absorbing alloy useful in the present invention is capable of electrochemically absorbing and desorbing hydrogen. Specifically, it is a misch metal nickel multi-component alloy represented by the formula:

$$MmNi_xAl_yM_z \quad (I)$$

wherein Mm is Misch metal, M is at least one element selected from the group consisting of Mn, Cu, Cr, Co, Ti, Nb, Zr and Si, and $2 \leqq x \leqq 5$, $0 < y \leqq 3$, $0 < z \leqq 4$ and $2.5 \leqq x+y+z \leqq 8.5$. If $x < 2$ or $Y > 3$, the hydrogen absorbing alloy will have a problem in the corrosion resistance in a caustic alkali solution and will not be durable in use for a long period of time. If $y = z = 0$, the equilibrium pressure of the hydrogen absorbing alloy will be high, and the above-mentioned effects for preventing the oxidation of electrode active particles will be small. Further, if $x > 5$ or $z > 4$, the amount of hydrogen absorbable to the hydrogen absorbing alloy decreases, and the effects of the present invention will be inadequate. It is particularly preferred that $2.5 \leqq x \leqq 4.5$, $0.3 \leqq y < 1.5$, $0.1 \leqq z \leqq 2.5$, and $4 \leqq x+y+z \leqq 6$. Further, when M is Ti, Nb or Zr, $0.1 \leqq z \leqq 1$ is preferred.

According to another embodiment of the present invention, the hydrogen absorbing alloy is a Misch metal nickel alloy represented by the formula:

$$Mm_pNi_qA_r \quad (II)$$

wherein Mm is misch metal, A is at least one element elected from the group consisting of Al, Ti, Zr and Nb, provided that Al alone is excluded, and $1 < p \leqq 1.3$, $3.5 \leqq q \leqq 5$ and $0 < r \leqq 2.5$. If $p \leqq 1$, the amount of hydrogen absorbed by the hydrogen absorbing alloy decreases with a decrease of p, and the equilibrium pressure of absorption and desorption tends to be high, whereby the effects of the present invention will be inadequate. If $p > 1.3$, there will be a problem in the corrosion resistance in a caustic alkali solution, and the alloy will be not durable in use for a long period of time. Preferably, $1.03 \leqq p \leqq 1.2$. If $q < 3.5$, the hydrogen absorbing alloy has a problem in the corrosion resistance in a caustic alkali solution and will not be durable in use for a long period of time. Further, if $q > 5$, the amount of hydrogen absorbed by the hydrogen absorbing alloy will decrease, and the equilibrium pressure of the absorption and desorption will be high, whereby the effects of the present invention will be inadequate. Preferably, $4 \leqq q \leqq 5$. If $r = 0$, the hydrogen overvoltage of the electrode will be too high in the case where whole of the electrode active metal particles is made of the hydrogen absorbing alloy, and the equilibrium pressure of the absorption and desorption will be high, whereby the effects of the present invention will be inadequate. On the other hand, if $r > 2.5$, the amount of hydrogen absorbable by the hydrogen absorbing alloy decreases, whereby the effects of the present invention will be inadequate. Preferably, $0 < r \leqq 2.5$.

The electrode active metal particles to be used in the present invention may be made of the above-mentioned hydrogen absorbing alloy alone or a combination of such a hydrogen absorbing alloy and Raney nickel and/or Raney cobalt. When the electrode active metal particles are made of the hydrogen absorbing alloy alone, the hydrogen absorbing alloy is preferably the one represented by the above formula (I) wherein M is at least one element selected from the group consisting of Ti, Nb and Zr due to the better bonding characteristics to the electrode core. On the other hand, when the electrode active metal particles are made of a combination of the hydrogen absorbing alloy and Raney metal, it is preferred that the hydrogen absorbing alloy is present in an amount of from 5 to 90% by weight, especially from 10 to 80% by weight, in the electrode active metal. If the proportion of the hydrogen absorbing alloy is less than 5% by weight, the amount of hydrogen discharged at the time of short-circuiting will be so small that active components such as nickel of cobalt will be oxidized by the short-circuiting, whereby the electrode activity will decrease, and the hydrogen overvoltage will increase. On the other hand, if the proportion exceeds 90% by weight, the proportion of Raney nickel and/or Raney cobalt having a low hydrogen overvoltage will be so small in some cases that the hydrogen overvoltage tends to be high.

The hydrogen absorbing alloys used in the present invention are produced by a conventional method disclosed in, for example, Journal of Less Common Metals, Vol. 79, page 207 (1981).

Further, it is known that these hydrogen absorbing alloys undergo brittle fracture due to the absorption and desorption of hydrogen and will be thereby pulverized. To prevent exfoliation due to such pulverization, the alloy may be preliminarily pulverized by mechanical pulverization or by repeating the absorption and desorption of hydrogen gas in a gas phase, and the pulverized alloy may be employed. Otherwise, to prevent such exfoliation, metal particles such as nickel powder, may be used as a matrix material in addition to the above Raney nickel or Raney cobalt, or a polymer powder or the like may be used as a binder.

The average particle size of the above hydrogen absorbing alloy particles is influential over the porosity of the electrode surface and over the dispersibility of particles during the preparation of the electrode which will be described hereinafter. However, the average particle size is usually within a range of from 0.1 to 100 μm.

Within the above range, the average particle size is preferably from 0.9 to 50 μm, more preferably from 1 to 30 μm, from the viewpoint of the porosity of the electrode surface, etc.

Further, the particles to be used for the present invention are preferably porous at their surface to attain a lower hydrogen overvoltage for the electrode.

This surface porosity does not necessarily mean that the entire surface of the particles is required to be porous, but it is sufficient that only the portion of the particles which is exposed from the above-mentioned metal layer, is porous.

In general, the higher the porosity, the better. However, if the porosity is excessive, the mechanical strength of the layer formed on the electrode core will be low. Therefore, the porosity is usually within a range of from 20 to 90%. Within this range, it is preferably from 35 to 85%, more preferably from 50 to 80%.

The above porosity is a value measured by a conventional mercury injection method or water substitution method.

The layer for firmly bonding the above electrode active metal particles to the metal substrate, is preferably made of the same material as a part of the component constituting the metal particles.

Thus, a large number of the above-mentioned particles are adhered on the surface of the cathode according to the present invention. The cathode surface has a multitude of micro-pores, when viewed macroscopically.

As such, the cathode of the present invention has a large number of particles having a low hydrogen overvoltage by themselves on the electrode surface, and, as already mentioned in the foregoing, the electrode surface has the micro-pores, on account of which the electrode active surface is enlarged for that porosity. Thus, the hydrogen overvoltage can be effectively reduced by the synergistic effect of the metal particles and the surface porosity.

In addition, the particles used in the present invention are firmly fixed to the electrode surface by a layer composed of the above-mentioned metal material, and the electrode is thereby less deteriorative, whereby the low hydrogen overvoltage thereof can be sustained over a remarkably long period of time.

The electrode core according to the present invention may be made of any suitable electrically conductive metal, for example, a metal selected from Ti, Zr, Fe, Ni, V, Mo, Cu, Ag, Mn, platinum group metals, graphite and Cr, or an alloy selected from these metals. Among these materials, Fe, Fe alloys (Fe-Ni alloy, Fe-Cr alloy, Fe-Ni-Cr alloy, etc.), Ni, Ni alloys (Ni-Cu alloy, Ni-Cr alloy, etc.), Cu and Cu alloys are preferred. The particularly preferred materials for the electrode core are Fe, Cu, Ni, Fe-Ni alloy, and Fe-Ni-Cr alloy.

The structure of the electrode core may take any appropriate shape and size in conformity with the structure of the electrode to be used. Its shape may be, for example, a shape of a plate, a porous plate, a net (such as expanded metal) or blinds. Such an electrode core may further be worked into a flat plate form, a curved plate form, or a cylindrical form.

The thickness of the layer according to the present invention may sufficiently be in a range of from 20 μm to 2 mm, or more preferably from 25 μm to 1 mm, although it depends also on the particle size of the particles to be used. The reason for limiting the thickness of the layer to the above range is that, in the present invention, a part of the above-mentioned particles adhered onto the layer of a metal provided on the electrode core are in such a state that they are embedded in the layer. For the ready understanding of such state, a cross-sectional view of the electrode surface according to the present invention is illustrated in FIG. 1 of the accompanying drawings. As shown in the Figure, the layer 2 made of a metal is provided on the electrode core 1, and a part of the electrode active metal particles 3 are contained in the layer so that they are exposed from the surface of the layer. The ratio of the particles in the layer 2 is preferably in a range of from 5 to 80% by weight, more preferably in a range of from 10 to 60% by weight. Further, an intermediate layer of a metal selected from Ni, Co, Ag and Cu may be interposed between the electrode core and the layer containing the metal particles of the present invention, to further improve the durability of the electrode according to the present invention. While such an intermediate layer may be made of the same or different kind of metal as that of the above-mentioned layer, it is preferable that the metal for the intermediate layer and the top layer be of the same kind from the standpoint of maintaining good adhesivity between the intermediate layer and the top layer. The thickness of the intermediate layer may sufficiently be in a range of from 5 to 100 μm from the point of its mechanical strength, etc. A more preferred range thereof is from 20 to 80 μm, and, a particularly preferred range thereof is from 30 to 50 μm.

Figure 2:
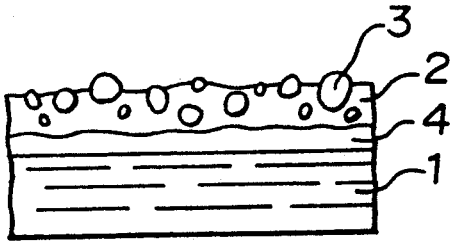
FIG. 2 is a cross-sectional view of the surface part of another embodiment of the electrode according to the present invention.

For the ready understanding of the electrode provided with such an intermediate layer, a cross-sectional view of the electrode is shown in FIG. 2. In the Figure, reference numeral 1 designates the electrode core, numeral 4 refers to the intermediate layer, numeral 2 denotes the layer containing the metal particles, and numeral 3 indicates the electrode active particles.

As the practical method of adhering the electrode active metal particles, there may be employed various expedients such as a composite plating method, a melt coating method, a baking method and a pressure forming and sintering method. Among them, the composite plating method is particularly preferable, because it is able to adhere the electrode active metal particles on the layer in good condition.

The composite plating method is such that the plating is carried out on the electrode core, as the cathode, in a bath prepared by dispersing metal particles containing e.g. nickel as a part of the components constituting the alloy, in an aqueous solution containing metal ions to form the metal layer, thereby electrolytically co-depositing the above-mentioned metal and the metal particles on the electrode core. More specifically, it is presumed that the metal particles are rendered to be bipolar in the bath due to influence of the electrical field, whereby the local current density for the plating is increased when they come to the vicinity of the surface of the cathode, and they will be electrolytically co-deposited on the electrode core by the metal plating due to the ordinary reduction of the metal ions when they come into contact with the cathode.

For example, when the nickel layer is to be adopted as the metal layer, there may be employed various nickel plating baths such as an all nickel chloride bath, a high nickel chloride bath, a nickel chloride/nickel acetate bath, a Watts bath and a nickel sulfamate bath.

The proportion of such metal particles in the bath should preferably be in a range of from 1 g/l to 200 g/l for the sake of maintaining in good condition the adhesion onto the electrode surface of the metal particles. Further, the temperature condition during the dispersion plating may range from 20° C. to 80° C., and the current density for the work may preferably be in a range of from 1 A/dm$^2$ to 20 A/dm$^2$.

It may, of course, be permitted to add to the plating bath an additive for reducing distortion, an additive for promoting the electrolytic co-deposition, or the like, as the case requires.

Also, with a view to further improving the adhesive strength of the metal particles, there may be carried out in an appropriate manner after completion of the composite plating the electrolytic plating or the non-electrolytic plating to such an extent that the metal particles may not be coated entirely, or the baking under heat in an inert or reductive atmosphere.

Further, as mentioned in the foregoing, when the intermediate layer is provided between the electrode core and the metal layer containing the metal particles, the electrode core is first subjected to nickel plating, cobalt plating or copper plating, after which the metal layer containing the metal particles is formed on the intermediate layer by the above-mentioned dispersion plating method or melt spraying method.

As the plating baths in such cases, various plating baths may be adopted as mentioned in the foregoing. For the copper plating, too, conventional plating baths may be adopted.

In this manner, there can be obtained an electrode of the construction, in which the electrode active metal particles containing the hydrogen absorbing alloy are adhered onto the electrode core through the metal layer.

In the following, another method for producing the cathode according to the present invention will be described.

The cathode of the present invention can be produced also by a melt coating method or a baking method. Namely, the hydrogen absorbing alloy powder or a mixture of the hydrogen absorbing alloy powder and other metal powder of low hydrogen overvoltage (for example, a powder mixture obtained by the melt and crushing method) is adjusted to a predetermined particle size, and then such a powder mixture is melt-sprayed on the electrode core by means of e.g. plasma or oxygen/actylene flame to form a coating layer on the electrode core, in which the metal particles are partially exposed, or a dispersion or slurry of these metal particles is coated on the electrode core, and then the coated layer is subjected to baking by calcination to obtain a desired coating layer.

Furthermore, the cathode according to the present invention may be obtained by prefabricating on electrode sheet containing the hydrogen absorbing alloy, and then attaching the electrode sheet onto the electrode core. In this case, the electrode sheet should preferably be prefabricated by a method wherein the hydrogen absorbing alloy particles and other metal particles (for example, a Raney alloy, etc. exhibiting a low hydrogen overvoltage characteristic) are blended with an organic polymer particles and molded into a desired shape, or after the molding, the shaped body is calcined to obtain the electrode sheet. In this case, the electrode active particles are, of course, exposed from the surface of the electrode sheet. The thus obtained electrode sheet is press-bonded onto the electrode core, and then firmly fixed to the electrode core by heating.

The electrode according to the present invention may, of course, be adopted as an electrode, particularly as a cathode, for electrolysis of an alkali metal chloride aqueous solution by means of an ion-exchange membrane method. Beside this, it may be employed as an electrode for electrolysis of an alkali metal chloride using a porous diaphragm (such as, for example, an asbestos diaphragm).

When it is used as the cathode for electrolysis of an alkali metal chloride, it sometimes happens that the iron content eluting into the catholyte from the material constituting the electrolytic cell is electrolytically deposited on the cathode to lower the electrode activity. In order to prevent this, it is effective to adhere to the cathode of the present invention a non-electronic conductive substance as disclosed in Unexamined Japanese Patent Publication No. 143482/1982.

Now, the present invention will be described in further detail with reference to Examples. However, it should be understood that the present invention is by no means restricted by such specific Examples.

EXAMPLES 1 to 15

The misch metal containing 50 wt % of Ce and 30 wt % of La multi component hydrogen absorbing alloy as identified in Table 1 was pulverized to a size of at most 25 μm. This powder was put into a nickel chloride bath (300 g/l of $NiCl_2.6H_2O$, 38 g/l of $H_3BO_3$) at a rate of 0.75 g/l. Further, a commercially available Raney nickel alloy powder (50% by weight of nickel and 50% by weight of aluminum, 500 mesh passed, manufactured by Nikko Rika) was added to the above plating bath at a rate of 4.5 g/l. While sufficiently agitating the bath, composite plating was conducted using an expanded metal of nickel as the cathode and a nickel plate as the anode. The temperature was 40° C., the pH was 2.5, and the current density was 3 A/dm$^2$. As a result, in each case, there was obtained a composite plated layer wherein the misch metal nickel multi-component hydrogen absorbing alloy and the Raney nickel alloy were coexistent, with the co-deposited quantity of the misch metal nickel multi-component hydrogen absorbing alloy being 0.7 g/dm$^2$ and the co-deposited quantity of the Raney nickel alloy being 2.8 g/dm$^2$, i.e. with the proportion of the co-deposited hydrogen absorbing metal in the electrode active metal particles being 20% by weight and the proportion of the Raney nickel alloy being 80% by weight. The thickness of this plated layer was about 150 μm, and the porosity was about 70%. This specimen was immersed in a 25% NaOH solution at 90° C. for 2 hours to develop aluminum of the Raney nickel alloy. Then, this electrode was used as the cathode for a sodium chloride electrolytic cell using $RuO_2$-$TiO_2$ as the anode and a fluorine-containing cationic ion-exchange membrane (a copolymer of $CF_2=CF_2$ and $CF_2=CFO(OF_2)_3COOCH_3$, ion exchange capacity: 1.45 meq/g resin, manufactured by Asahi Glass Company Ltd.) as the ion exchange membrane, to test its resistance against short-circuiting. The following short-circuiting test was conducted on the 200th day after the initiation of the electrolysis using a 3N NaCl solution as the anolyte and a 35% NaOH solution as the catholyte at 90° C. at a current density of 30 A/dm$^2$.

Firstly, the electrolysis was stopped by short-circuiting the anode and the cathode during the electrolysis by means of a copper wire and left to stand for about 5 hours. During this period, the current flowing from the cathode to the anode was observed. Meantime, the temperature of the catholyte was maintained at 90° C. Thereafter, the copper wire was removed, and the electrolysis was conducted for one day. This operation was repeated five times.

After completion of the test, the electrolysis was continued for 30 days. Then, the electrode was taken out, and the hydrogen overvoltage thereof was measured in a 35% NaOH solution at 90° C. at a current density of 30 A/dm$^2$. It is shown in Table 1 together with the value before the test. In each case, no substantial change of the hydrogen overvoltage was observed as between before and after the test.

COMPARATIVE EXAMPLE 1

An electrode was prepared in the same manner as in Example 1 except that $MmNi_{4.7}Al_{0.2}Mn_{0.1}$ in Example 1 was changed to $MmNi_5$, and it was tested in the same manner. The results are shown in Table 1. After the test, an increase of the hydrogen overvoltage of 100 mV was observed.

EXAMPLE 16

Composite plating was conducted in the same manner as in Example 4 except that the amounts of the metal powders added to the nickel chloride bath in Example 4 were changed to 5 g/l of $MmNi_{2.5}Al_{0.5}Co_2$ and 5 g/l of the Raney nickel alloy powder. As a result, a composite plated layer was obtained in which $MmNi_{2.5}Al_{0.5}Co_2$ and the Raney nickel alloy were coexistent, with the co-deposited quantity of $MmNi_{2.5}Al_{0.5}Co_2$ being 5 g/dm$^2$ and the co-deposited quantity of the Raney nickel alloy being 2 g/dm$^2$, i.e. with the proportion of $MmNi_{2.5}Al_{0.5}Co_2$ being 71%, and the proportion of the Raney nickel alloy being 29%. The thickness of this plated layer was about 280 μm, and the porosity was about 65%.

Using this electrode, the short-circuiting test was conducted in the same manner as in Example 4. After the test, the hydrogen overvoltage was measured and found to be unchanged at all at a level of 75 mV.

EXAMPLE 17

$MmNi_{4.8}Al_{0.1}Ti_{0.1}$ powder (at most 30 μm) and commercially available stabilized Raney nickel powder ("Dry Raney Nickel" tradename, manufactured by Kawaken Fine Chemicals Co., Ltd.) were put into a high nickel chloride bath (200 g/l of $NiSO_4.6H_2O$, 175 g/l of $NiCl_2.6H_2O$, 40 g/l of $H_3BO_3$) at a rate of 10 g/l each. While sufficiently agitating the bath, composite plating was conducted using a punched metal of nickel as the cathode and a nickel plate as the anode. The temperature was 50° C., the pH was 3.0, and the current density was 4 A/dm$^2$. As a result, a composite plated layer containing $MmNi_{4.8}Al_{0.1}Ti_{0.1}$ and the stabilized Raney nickel, was obtained, wherein the co-deposited quantity of $MmNi_{4.8}Al_{0.1}Ti_{0.1}$ was 5 g/dm$^2$ and the co-deposited quantity of the stabilized Raney nickel was 2 g/dm$^2$, i.e. the proportion of the co-deposited $MmNi_{4.8}Al_{0.1}Ti_{0.1}$ in the electrode active metal particles was 71%, and the proportion of the Raney nickel alloy was 29%. The thickness of the plated layer was about 250 μm, and the porosity was about 60%. Using this electrode, the short-circuiting test was conducted in the same manner as in Example 1. After the test, the hydrogen overvoltage was measured and found to be 70 mV, which was not substantially different from the value prior to the test.

EXAMPLE 18

Composite plating was conducted under the same conditions as in Example 4 except that the Raney nickel alloy powder was changed to developed Raney nickel. As a result, a composite plated layer containing $MmNi_{2.5}Al_{0.5}Co_{2.0}$ and the developed Raney nickel, was obtained, wherein the co-deposited quantity of $MmNi_{2.5}Al_{0.5}Co_{2.0}$ was 5 g/dm$^2$ and the co-deposited quantity of the developed Raney nickel was 3 g/dm$^2$. Namely, a composite plated layer was obtained wherein $MmNi_{2.5}Al_{0.5}Co_{2.0}$ and the Raney nickel alloy were coexistent, with the proportion of the co-deposited $MmNi_{2.5}Al_{0.5}Co_{2.0}$ in the electrode active metal particles being 63% and the proportion of the Raney niCkel alloy being 37%. The thickness of this plated layer was about 400 μm, and the porosity was about 70%. Using this electrode, the short-circuiting test was conducted in the same manner as in Example 1. The hydrogen overvoltage after completion of the test was 80 mV, which was not different from the value prior to the test.

TABLE 1

| | Hydrogen absorbing alloy | Hydrogen overvoltage (mV) Before the test | After the test |
|---|---|---|---|
| Example 1 | $MmNi_{4.7}Al_{0.2}Mn_{0.1}$ | 80 | 82 |
| Example 2 | $MmNi_{4.5}Al_{0.45}Cu_{0.05}$ | 80 | 83 |
| Example 3 | $MmNi_{4.6}Al_{0.3}Cr_{0.1}$ | 82 | 85 |
| Example 4 | $MmNi_{2.5}Al_{0.5}Co_{2.0}$ | 79 | 80 |
| Example 5 | $MmNi_{4.6}Al_{0.3}Ti_{0.1}$ | 81 | 84 |
| Example 6 | $MmNi_{4.5}Al_{0.45}Nb_{0.05}$ | 80 | 83 |
| Example 7 | $MmNi_{4.5}Al_{0.4}Zr_{0.1}$ | 80 | 81 |
| Example 8 | $MmNi_{4.5}Al_{0.4}Si_{0.1}$ | 83 | 85 |
| Example 9 | $MmNi_{4.6}Al_{0.2}Mn_{0.1}Zr_{0.1}$ | 82 | 84 |
| Example 10 | $MmNi_{2.9}Al_{0.5}Co_{1.5}Ti_{0.1}$ | 82 | 83 |
| Example 11 | $MmNi_{2.63}Al_{0.53}Co_{2.11}$ | 80 | 80 |
| Example 12 | $MmNi_{3.13}Al_{0.63}Co_{2.50}$ | 80 | 80 |
| Example 13 | $MmNi_{3.57}Al_{0.71}Co_{2.86}$ | 83 | 87 |
| Example 14 | $MmNi_{2.27}Al_{0.45}Co_{1.82}$ | 80 | 110 |
| Example 15 | $MmNi_{4.17}Al_{0.83}Co_{3.33}$ | 85 | 120 |
| Comparative Example 1 | $MmNi_5$ | 80 | 180 |

EXAMPLES 19 to 25 and COMPARATIVE EXAMPLE 2

The misch metal nickel multi-component hydrogen absorbing alloy as identified in Table 2 was pulverized to a size of at most 25 μm. This powder was put into a nickel chloride bath (300 g/l of $NiCl_2.6H_2O$, 38 g/l of $H_3BO_3$) at a rate of 0.75 g/l. Further, a commercially available Raney nickel alloy powder (50% by weight of nickel and 50% by weight of aluminum, 500 mesh passed, manufactured by Nikko Rika) was added to the above plating bath at a rate of 4.5 g/l. While sufficiently agitating the bath, composite plating was conducted using an expanded metal of nickel as the cathode and a nickel plate as the anode. The temperature was 40° C., the pH was 2.5, and the current density was 3 A/dm$^2$.

As a result, in each case, there was obtained a composite plated layer wherein the Misch metal nickel multi-component hydrogen absorbing alloy and the Raney nickel alloy were coexistent, with the co-deposited quantity of the misch metal nickel multi-component hydrogen absorbing alloy being 0.8 g/dm$^2$ and the co-deposited quantity of the Raney nickel alloy being 2.8 g/dm$^2$, i.e. with the proportion of the co deposited hydrogen absorbing metal in the electrode active metal particles being 24% by weight and the proportion of the Raney nickel alloy being 76% by weight. The thickness of this plated layer was u about 150 μm, and the porosity was about 70%. This specimen was immersed in a 25% NaOH solution at 90° C. for 2 hours to develop aluminum of the Raney nickel alloy. Then, this electrode was used as the cathode for a sodium chloride electrolytic cell using $RuO_2$-$TiO_2$ as the anode and a fluorine-containing cationic ion-exchange membrane (hydrolysate of a copolymer of $CF_2=CF_2$ and $CF_2=CFO(OF_2)_3COOCH_3$, ion exchange capacity: 1.45 meq/g resin, manufactured by Asahi Glass Company Ltd.) as the ion exchange membrane, and the following two types of tests were conducted.

Test 1: Test for resistance against short-circuiting

The following short-circuiting test was conducted on the 200th day after the initiation of the electrolysis using a 3N NaCl solution as the anolyte and a 35% NaOH solution as the catholyte at 90° C. at a current density of 30 A/dm$^2$.

Firstly, the electrolysis was stopped by short-circuiting the anode and the cathode by means of a copper wire and left to stand for about 5 hours. During this period, the current flowing from the cathode to the anode was observed. Meantime, the temperature of the catholyte was maintained at 90° C. Thereafter, this copper wire was removed, and the electrolysis was conducted for one day. This operation was repeated five times.

After completion of the test, the electrolysis was continued for further 30 days, and then the electrode was taken out, and the hydrogen overvoltage thereof was measured in a 35% NaOH solution at 90° C. at a current density of 30 A/dm$^2$.

Test 2: Test for resistance against small reverse current

The electrolysis was conducted in the same manner as in Test 1, and on the 50th day after the initiation of the electrolysis, the following operation was conducted.

The electrolysis was stopped by short-circuiting the anode and the cathode during the electrolysis by means of a copper wire with an ohmic loss of 1.2 V, and left to stand for 48 hours. Further, the short-circuiting copper wire was changed to a copper wire with an ohmic loss of 0.8 V, and the short-circuiting was continued for further 120 hours. During this period, the current flowing from the cathode to the anode was observed. The electrolytic cell was left to naturally cool at the same time as the initiation of the short circuiting operation. Then, the electrolytic cell was heated to 90° C., and the copper wire was removed, and the electrolysis was conducted for one week. This operation was repeated four times.

After completion of the test, the electrolysis was continued for 30 days. Then, the electrode was taken out, and the overvoltage thereof was measured in a 35% NaOH solution at 90° C. at a current density of 30 A/dm$^2$.

The results are shown in Table 2 together with the hydrogen overvoltage before the test.

TABLE 2

| | Hydrogen absorbing alloy | Hydrogen overvoltage (mV) Before the test | Test 1 | Test 2 |
|---|---|---|---|---|
| Example 19 | $Mm_{1.2}Ni_{4.5}Ti_{0.5}$ | 85 | 90 | 89 |
| Example 20 | $Mm_{1.3}Ni_5Zr_{0.5}$ | 87 | 95 | 90 |
| Example 21 | $Mm_{1.03}Ni_{3.5}NbAl$ | 85 | 95 | 95 |
| Example 22 | $Mm_{1.05}Ni_4Ti_{0.5}Al$ | 83 | 89 | 88 |
| Example 23 | $Mm_{1.1}Ni_4Zr_{0.5}Al_{0.5}$ | 85 | 90 | 90 |
| Example 24 | $Mm_{1.5}Ni_{3.5}Zr_2Al$ | 85 | 115 | 135 |
| Example 25 | $MmNi_3Nb_2Al_{1.5}$ | 87 | 125 | 140 |
| Comparative Example 2. | $MmNi_5Ti$ | 80 | 190 | 150 |

EXAMPLE 26

$Mm_{1.1}Ni_{4.5}Ti_{0.5}Al_{0.5}$ powder (at most 30 μm) and commercially available stabilized Raney nickel powder ("Dry Raney Nickel" tradename, manufactured by Kawaken Fine Chemicals Co., Ltd.) were put into a high nickel chloride bath (200 g/l of $NiSO_4.6H_2O$, 175 g/l of $NiCl_2.6H_2O$, 40 g/l of $H_3BO_3$) at a rate of 10 g/l each. While sufficiently agitating the bath, composite plating was conducted using a punched metal of nickel as the cathode and a nickel plate as the anode. The temperature was 50° C., the pH was 3.0, and the current density was 4 A/dm$^2$. As a result, a composite plated layer containing $Mm_{1.1}Ni_{4.5}Ti_{0.5}Al_{0.5}$ and the stabilized Raney nickel, was obtained, wherein the co-deposited quantity of $Mm_{1.1}Ni_{4.5}Ti_{0.5}Al_{0.5}$ was 4.5 g/dm$^2$, and the co-deposited quantity of the stabilized Raney niCkel was 1.5 g/dm$^2$, i.e. the proportion of the co-deposited $Mm_{1.1}Ni_{4.5}Ti_{0.5}Al_{0.5}$ in the electrode active metal particles was 75%, and the proportion of the Raney nickel alloy was 25%. The thickness of this plated layer was 220 μm, and the porosity was about 65%. Using this electrode, the tests were conducted in the same manner as in Example 19. After the tests, the hydrogen overvoltage was measured and found to be 95 mV, which was not substantially different from the value before the test.

EXAMPLE 27

Composite plating was conducted in the same manner as in Example 22 except that no Raney nickel alloy powder was used, and the amount of $Mm_{1.03}Ni_4Ti_{0.5}Al$ added to the plating bath was changed to 6 g/l. Namely, the electrode active metal particles were those made of $Mm_{1.03}Ni_4Ti_{0.5}Al$ only. As a result, a composite plated layer wherein the co-precipitated quantity of $Mm_{1.03}Ni_{0.4}Ti_{0.5}Al$ was 4.5 g/dm$^2$, was obtained. The thickness of this plated layer was about 200 μm, and the porosity was about 70%.

Using this electrode, the tests were conducted in the same manner as in Example 22. However, since no Raney nickel was employed, no development of Al before the initiation of the electrolysis was conducted. After completion of the tests, the hydrogen overvoltage was measured and found to be 95 mV, which was not substantially different from the value before the tests.

EXAMPLE 28

Composite plating was conducted in the same manner as in Example 27 except that $Mm_{1.2}Ni_4Al_{0.7}Zr_{0.3}$ was used instead of $Mm_{1.03}Ni_4Ti_{0.5}Al$. As a result, a composite plated layer wherein the co-deposited quantity of $Mm_{1.02}Ni_4Al_{0.7}Zr_{0.3}$ was 4.2 g/dm$^2$, was obtained. The thickness of the plated layer was about 190 μm, and the porosity was about 65%.

Using this electrode, the tests were conducted in the same manner as in Example 27. After completion of the tests, the hydrogen overvoltage was measured and found to be 100 mV, which was not substantially different from the value before the tests.

EXAMPLE 29

Composite plating was conducted in the same manner as in Example 27 except that $Mm_{1.02}Ni_4AlNb$ was used instead of $Mm_{1.03}Ni_4Ti_{0.5}Al$. As a result, a composite plated layer wherein the co-deposited quantity of $Mm_{1.02}Ni_4AlNb$ was 4.0 g/dm$^2$, was obtained. The thickness of the plated layer was about 190 μm, and the porosity was about 70%.

Using this electrode, the tests were conducted in the same manner as in Example 27. After completion of the tests, the hydrogen overvoltage was measured and found to be 130 mV, which was not substantially different from the value before the tests.

What is claimed is:

1. A highly durable cathode with a low hydrogen overvoltage, which comprises an electrode core and electrode active metal particles provided on the core, wherein at least a part of said electrode active metal particles is made of a hydrogen absorbing alloy electrochemically absorbing and desorbing hydrogen, and said hydrogen absorbing alloy is represented by the formula:

$$MmNi_xAl_yM_z \quad (I)$$

wherein Mm is misch metal, M is at least one element selected from the group consisting of Mn, Cu, Cr, Co, Ti, Nb, Zr and Si, and $2 \leqq x \leqq 5$, $0 < y \leqq 3$, $0 < z \leqq 4$ and $2.5 \leqq x+y+z \leqq 8.5$.

2. The highly durable cathode with a low hydrogen overvoltage according to claim 1, wherein M is at least one element selected from the group consisting of Ti, Nb and Zr, and the electrode active metal particles are entirely made of the hydrogen absorbing alloy.

3. The highly durable cathode with a low hydrogen overvoltage according to claim 1, wherein a part of the electrode active metal particles is made of Raney nickel Raney cobalt, or a mixture of Raney nickel and Raney cobalt.

4. The highly durable cathode with a low hydrogen overvoltage according to claim 3, wherein a proportion of the hydrogen absorbing alloy in the electrode active metal particles is from 5 to 90% by weight.

5. The highly durable cathode with a low hydrogen overvoltage according to claim 1, wherein the electrode active particles are adhered onto the electrode core by a plating metal.

6. The highly durable cathode with a low hydrogen overvoltage according to claim 5, wherein the plating metal is the same as that of a part of all of components constituting the electrode active metal particles.

7. A highly durable cathode with a low hydrogen overvoltage, which comprises an electrode core and electrode active metal particles provided on the core, wherein at least a part of said electrode active metal particles is made of a hydrogen absorbing alloy electrochemically absorbing and desorbing hydrogen, and said hydrogen absorbing alloy is represented by the formula:

$$Mm_pNi_qA_r \quad (II)$$

wherein Mm is misch metal, A is at least one element selected from the group consisting of Al, Ti, Zr and Nb, provided that Al alone is excluded, and $1 < p \leqq 1.3$, $3.5 \leqq q \leqq 5$ and $0 < r \leqq 2.5$.

* * * * *